United States Patent [19]

Mellious

[11] 4,128,180

[45] Dec. 5, 1978

[54] APPARATUS FOR ADAPTING MATERIAL HANDLING EQUIPMENT FOR CONTAINER UNLOADING AND METHOD OF USING

[76] Inventor: Donald Mellious, Box 266, Selkirk, N.Y. 12158

[21] Appl. No.: 823,280

[22] Filed: Aug. 10, 1977

[51] Int. Cl.[2] ..... B65G 67/24

[52] U.S. Cl. ..... 214/44 A; 180/68 P; 214/152; 280/764

[58] Field of Search ..... 214/17 DB, 40, 44 R, 214/44 A, 83.26, 130 R, 138 R, 152; 180/681; 280/764

[56] References Cited

U.S. PATENT DOCUMENTS 2,801,014 7/1957 Colson ..... 214/44 A X

FOREIGN PATENT DOCUMENTS 381591 8/1973 U.S.S.R. ..... 214/44 A

*Primary Examiner*—Robert G. Sheridan

[57] ABSTRACT

Self propelled material handling equipment items, such as backhoes, are modified to facilitate their use in unloading open top containers, such as railway gondola cars. The modifications comprise the provision of a smooth, solid, underplate at the lower extremity of the undercarriage of the material handling equipment item, and extending laterally beyond the undercarriage to provide a skid surface upon which the material handling equipment item may be supported on, and propelled across, the edges of an open top container and the contents of the container, and clamp members installed on outriggers of the material handling equipment item for engaging the sidewalls of an open top container to provide for positioning and support of the material handling equipment item on the container. The invention also includes method for conducting an unloading operation and for moving the equipment item from container to container.

15 Claims, 13 Drawing Figures

APPARATUS FOR ADAPTING MATERIAL HANDLING EQUIPMENT FOR CONTAINER UNLOADING AND METHOD OF USING

This invention relates to method and apparatus for unloading open top containers. More particularly, this invention relates to improvements in material handling equipment, such as backhoes, to adapt them for convenient and efficient use in the unloading of material from large open top containers.

Both discrete products, such as lumber products, metal ingots, and products made discrete by packaging as in bags or the like, and particulate, fungible products, such as sand, coal, gravel, and grain are frequently transported in open top containers such as, for example, railway gondola cars. In the prior art, the unloading of open top containers, such as railway gondola cars, has presented a variety of problems which have been dealt with by differing techniques in differing situations. No single unloading technique, known to the prior art, provides satisfactory results in all situations.

The techniques of the prior art for unloading open top containers such as gondola cars include manual unloading, the use of car dumpers, and the use of cranes, shovels, or the like. In the case of the use of cranes, shovels, or the like, for unloading of railway gondola cars, the prior art includes the use of a crane fixedly positioned alongside railway trackage for unloading cars which are successively brought alongside the crane by being propelled along the track, the use of cranes, shovels, or backhoes supported atop fixed frame members which straddle railway trackage and the cars running thereon to permit the material handling machine atop the frame to unload the contents of cars as they run beneath the frame member, and the use of shovels, backhoes, ad the like installed upon moveable underframe members which straddle railroad trackage and support the material handling machine at a height exceeding the height of a railroad car to enable the machine to be straddlingly transported above a line of railroad cars to unload the same as they come within range of the shovel, scoop, or bucket of the material handling equipment.

Each of the prior art car unloading techniques is quite expensive, and presents other disadvantages in various operations. Manual unloading is extremely expensive in terms of the cost of labor. The use of a car dumper requires a very large capital expenditure for the device, requires a large space for its construction and use, and limits car unloading to the point at which the dumper device is located thereby creating a large pile of cargo at a single location which must, in most cases, be retransported by other conveyances. Similarly, the use of a crane fixedly installed alongside railway trackage, and the use of material handling equipment supported atop fixed frame members straddling railway trackage, also involve a substantial capital outlay and limit the unloading of cargo to the point at which the apparatus is located. The use of moveable underframe members for straddlingly supporting material handling equipment above railway trackage and the cars thereon permits material to be off-loaded from the cars alongside each car, rather than at a single point, and would further permit a reasonable additional spacing of the off-loaded cargo, if desired, by moving the train from time to time, and moving the unloading apparatus above the train to unload each car at the point at which it is desired to unload that car. However, moveable track straddling frame members are very massive and are accordingly highly fuel inefficient vehicles, are typically capable of moving at only very low speeds, and therefore the use of this technique to off-load cargo at preselected locations is of limited utility and not practical when it is desired to off-load cargo at widely separated locations. It may also be noted that moveable track straddling frame members are substantially more expensive to construct than the fixed variety.

Because of the foregoing considerations, in situations in which it is desired to off-load cargo from, for example, gondola cars, at widely separated locations, the prior art has relied exclusively upon manual unloading and suffered the very high labor costs of this technique. The method and apparatus of this invention has a particular utility in improving the efficiency of off-loading material from open top containers at widely separated locations, but the invention hereinafter described should not be considered so limited, as it provides advantageous method and apparatus for unloading open top containers generally under any conditions.

As another, specific, example of an operation in which significant improvement has been obtained by the use of the unloading method and apparatus of this invention, and not by way of limitation upon the applicability of this invention, railway right-of-way maintenance operations will be considered next. The operation of a railroad requires continuous maintenance of the right-of-way, including periodic replacement of ties, rails, and the like. For example, when tie replacement is scheduled for a portion of a railroad's right-of-way, a plurality of gondola cars are loaded with railway ties and coupled into a maintenance train. The maintenance train proceeds along the right-of-way to each point at which tie replacement is required and stops for the maintenance crew to unload and replace ties. The tie replacement operation as presently practiced requires a four or five man crew on the gondola car being unloaded. For a high side gondola, which typically holds approximately four hundred railroad ties, a crew operating in accordance with prior art practice will unload approximately one car per work day at a cost of twelve to fifteen hundred dollars.

It is, accordingly, an object of this invention to provide novel method and apparatus for efficiently unloading large open top containers.

It is another object of this invention to provide such apparatus comprising an item of material handling equipment having modifications installed thereon to enable the material handling equipment item to be supported upon the side walls of an open top container and to be operated thereon to unload the contents thereof.

Another object of this invention is to provide such apparatus wherein the modifications may be permanently installed upon the item of material handling equipment, and the item of equipment operated in conventional fashion for tasks other than container unloading without the necessity of removing the modification items therefrom.

It is another object of this invention to provide such apparatus whereby the material handling equipment item may be co-transported atop the open top container to be unloaded as a nonpowered cargo item.

Yet another object of this invention is to provide such apparatus whereby portions of the contents of an open top container may be efficiently unloaded at widely separated locations.

A further object of this invention is to provide such method and apparatus wherein the item of material handling equipment can be mounted upon the open top container to be unloaded under its own power.

Another object of this invention is to provide such method and apparatus wherein the equipment item may be moved from container to container in a train of containers under its own power.

It is another object of this invention to provide such apparatus wherein the modifications to the material handling equipment are simple and inexpensive to install and are inexpensive to fabricate.

Another object of this invention is to provide such method and apparatus which is particularly adaptable to railway right-of-way maintenance operations.

Briefly, and in accordance with one embodiment of this invention, an item of material handling equipment is provided with a substantially smooth, continuous, skidplate member underlying a portion of the undercarriage of the material handling equipment and extending beyond a portion thereof to provide a skid surface upon which the material handling equipment may be supported on, and propelled across, the edges of an open top container and the contents of the container. Clamp members for engaging the sidewalls of an open top container are installed on the stabilizer arms of the material handling equipment to provide for positioning and support of the material handling equipment item on the open top container.

In operation, a first working member of the material handling equipment item, for example the bucket element of a front end loader assembly, is placed upon an edge of the open top container to be unloaded and is depressed to raise the end of the material handling equipment item from the ground at an angle so that the extended end of the skidplate engages the top surface of the end wall of a container to be unloaded. Subsequently, a second working member of the material handling equipment item, for example boom, dipperstick, and bucket assembly in a backhoe, is depressed against the surface behind the material handling equipment item to raise the rear portion of the equipment item to the desired level. Thereafter, through cooperative operation of the main propulsion means of the material handling equipment item and the material handling members of the equipment item, the machine is slid up onto the open top container riding on its skidplate. Once the item is mounted atop the container, and prior to commencement of unloading operations, the stabilizer arms are extended so that the clamp members thereon engage the upper edges of the side walls of the open top container. Movement from container to container is effected in a similar fashion.

The novel features of this invention sought to be patented are set forth with particularity in the appended claims. The invention, together with further objects and advantages thereof, may be understood from a reading of the following specification and appended claims in view of the accompanying drawings in which:

Figure 6:
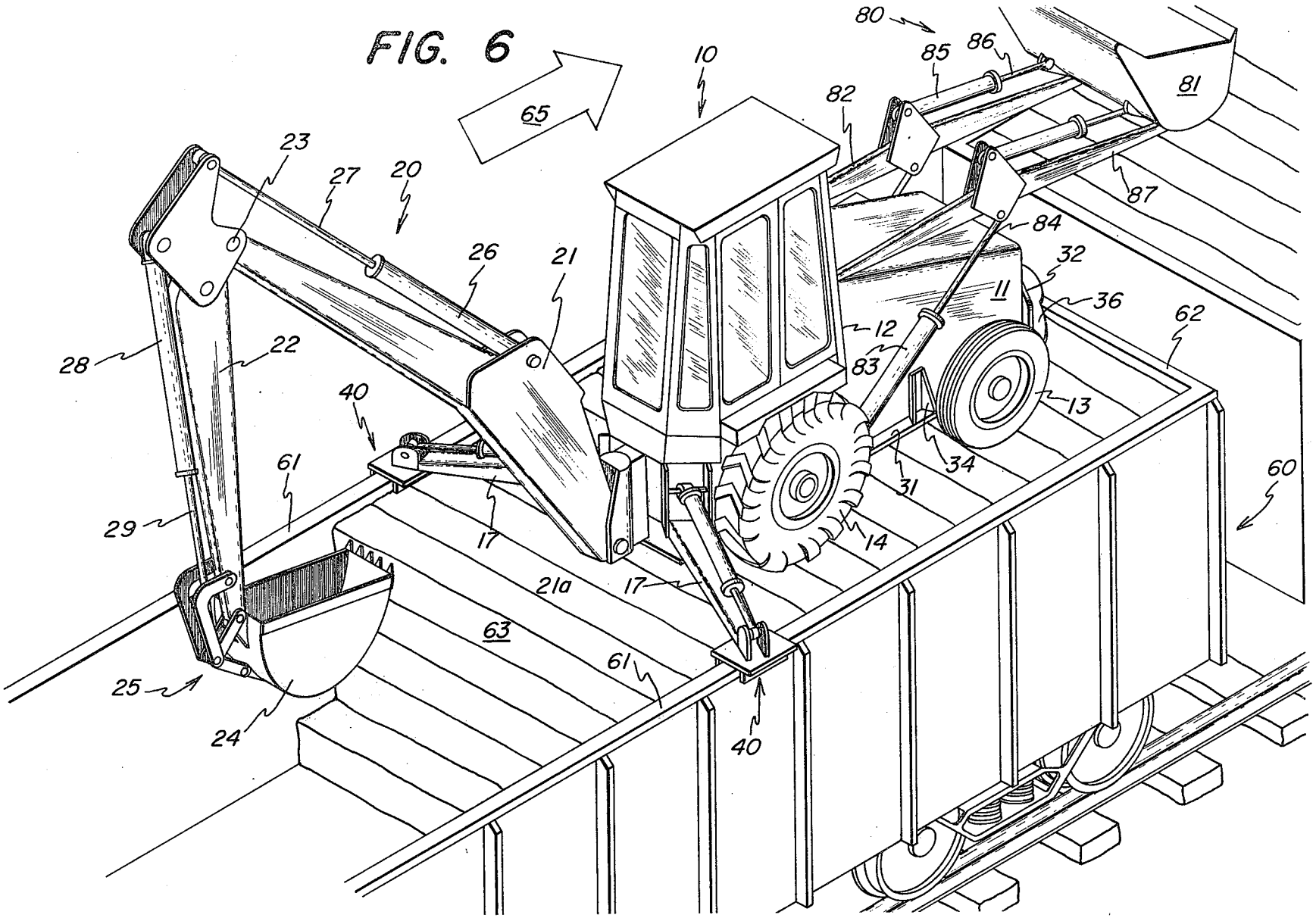
FIG. 6 is a perspective view of apparatus in accordance with this invention operatively disposed, for unloading the contents thereof, upon a railway gondola car.
Figure 7:
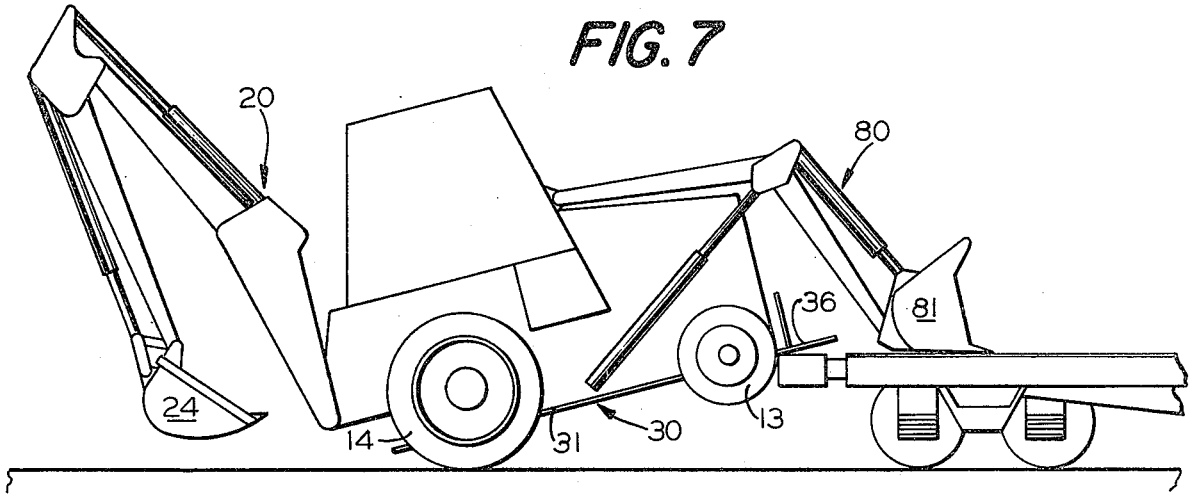
Figure 8:
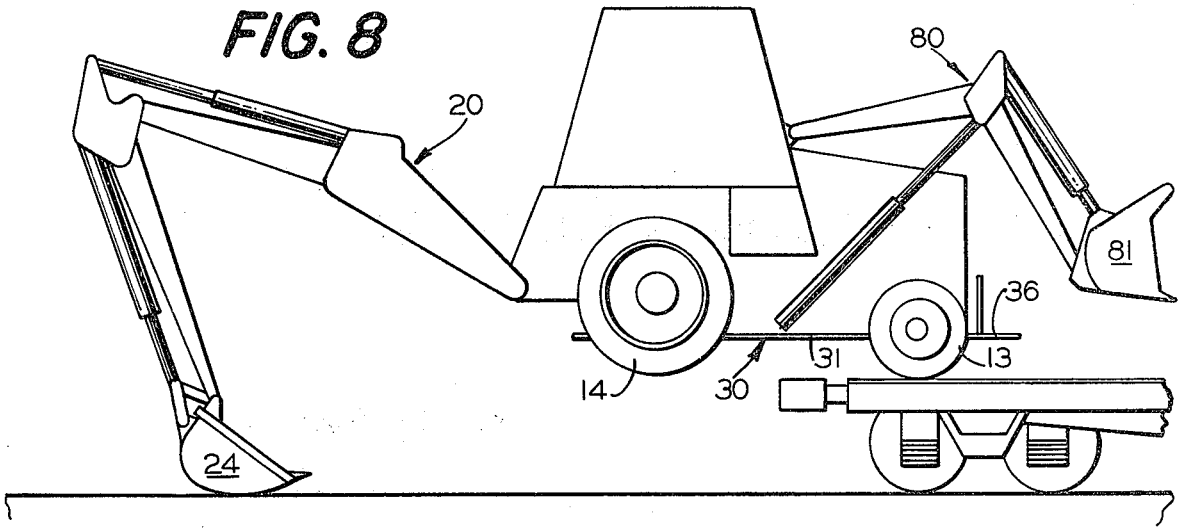
Figure 9:
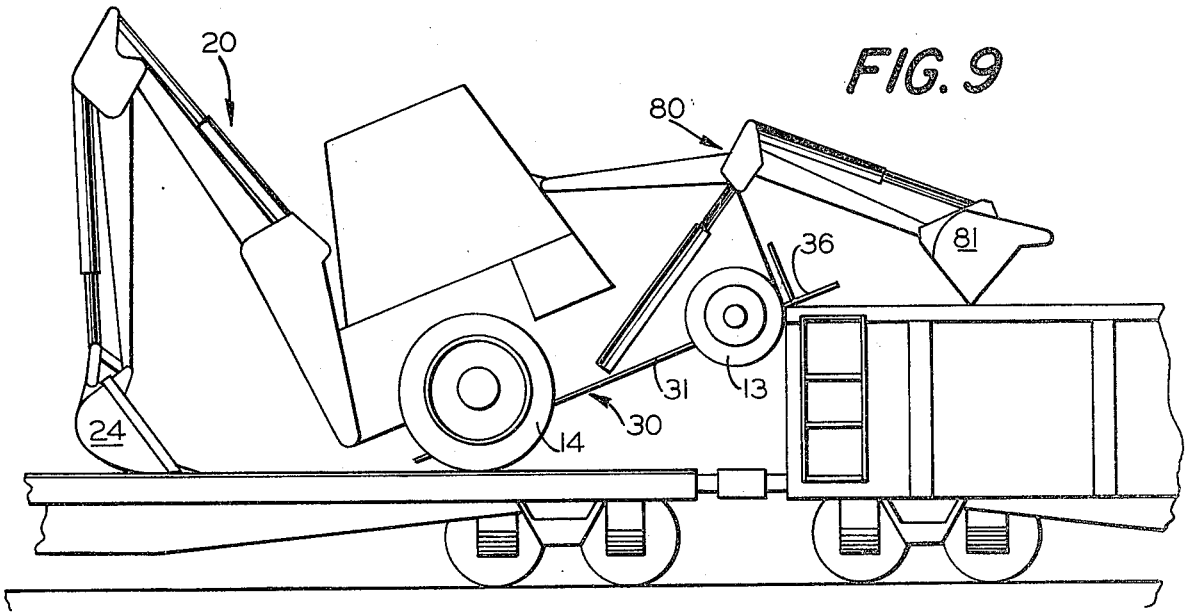
Figure 10:
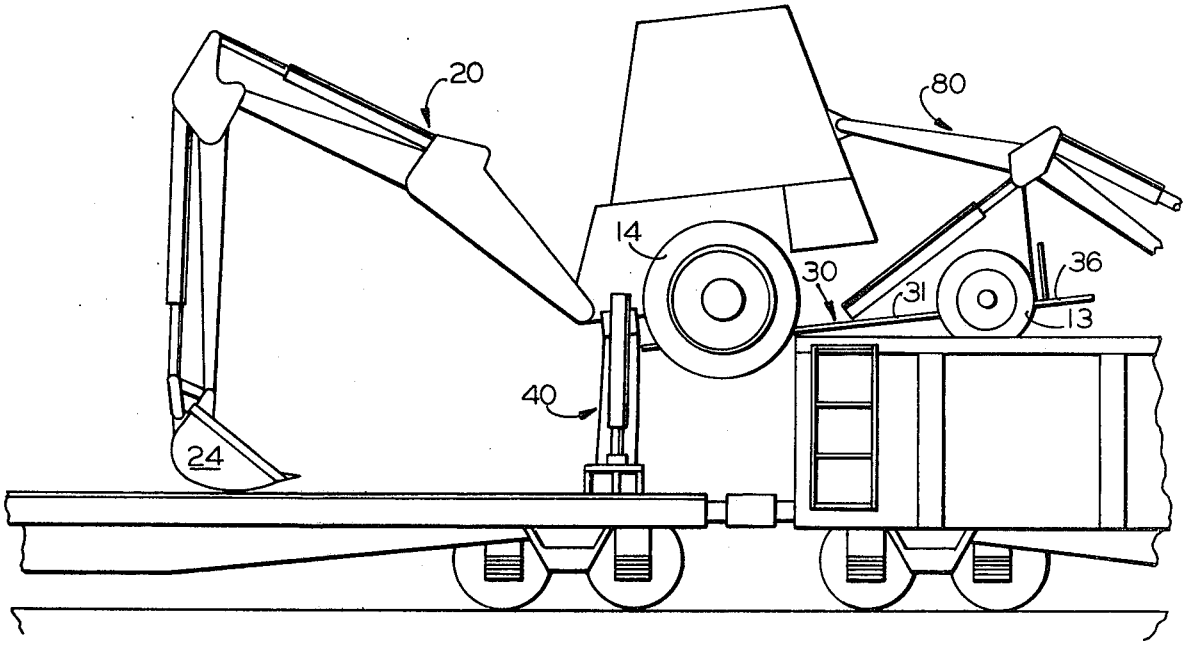
Figure 11:
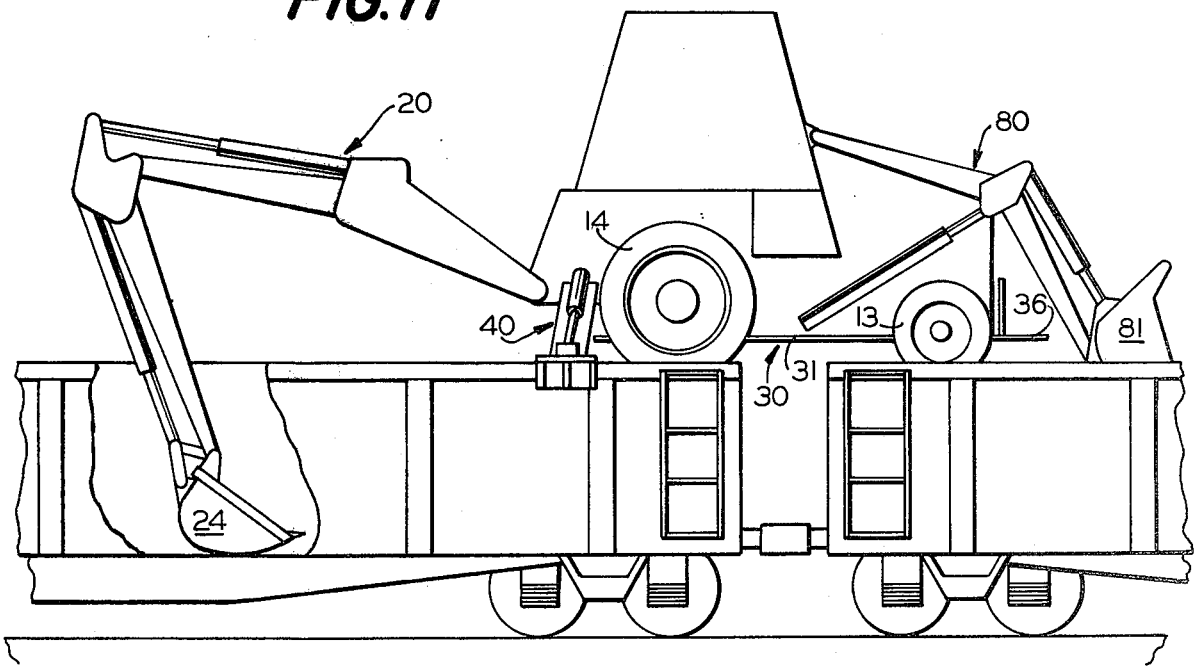
Figure 12:
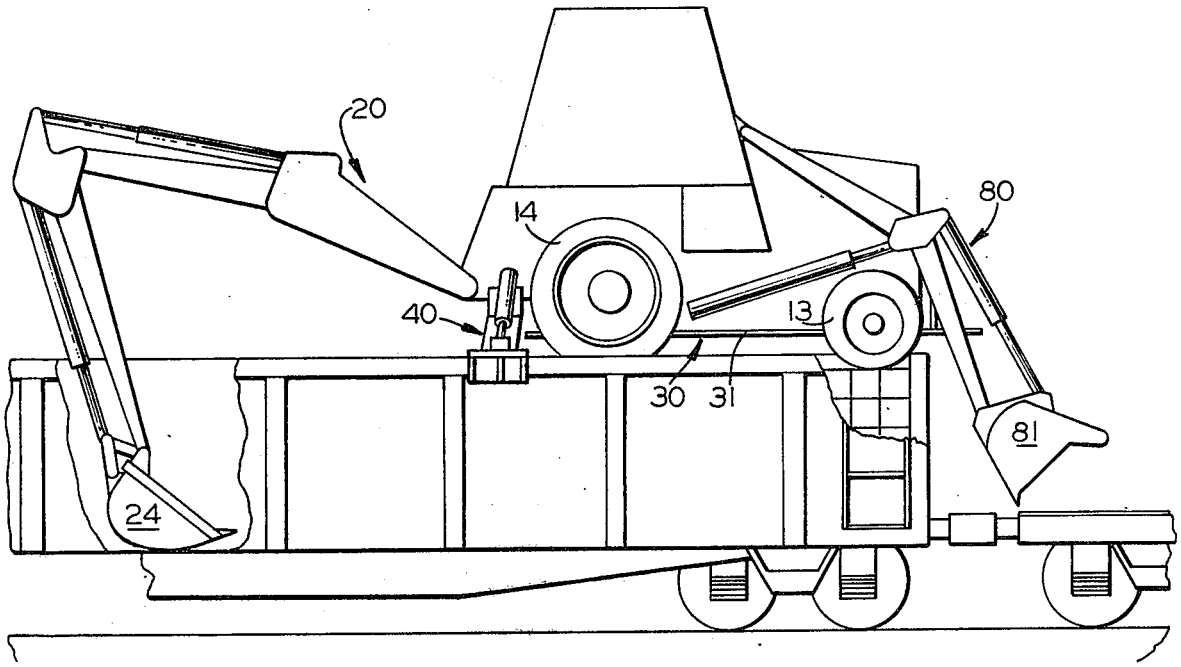
Figure 13:
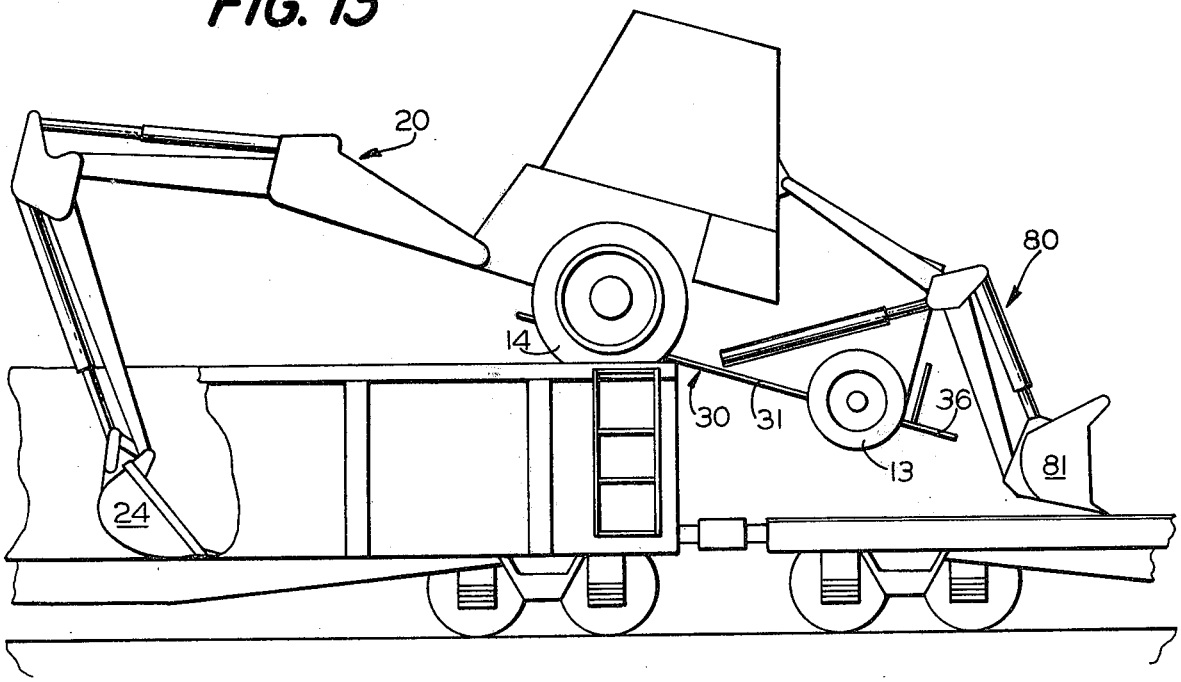

FIGS. 7 through 13, inclusive, are simplified side elevation views of apparatus in accordance with this invention shown in operative conjunction with railway rolling stock items, which, taken together with the showing of FIG. 6, illustrate an embodiment of the process of this invention whereby the apparatus of this invention is mounted upon a train of railway cars, moved across the train from car to car, and demounted from the train of cars under its own power.

This invention has been actually reduced to practice by the installation of skidplate and clamp members, as described herein, on a Case model 580B backhoe. The drawings, and the detailed description set forth hereinbelow are largely related particularly to the embodiment actually reduced to practice. The invention, however, is to be understood to be not so limited. For example, the improvements of this invention may be advantageously applied to machines other than backhoes, and to backhoes of differing size and configuration from that of the 580B Case. As a particular example, the 580B Case is a backhoe having a rubber tire tractor and the improvements of this invention are equally applicable to tracked or rubber tired vehicles.

Figure 1:
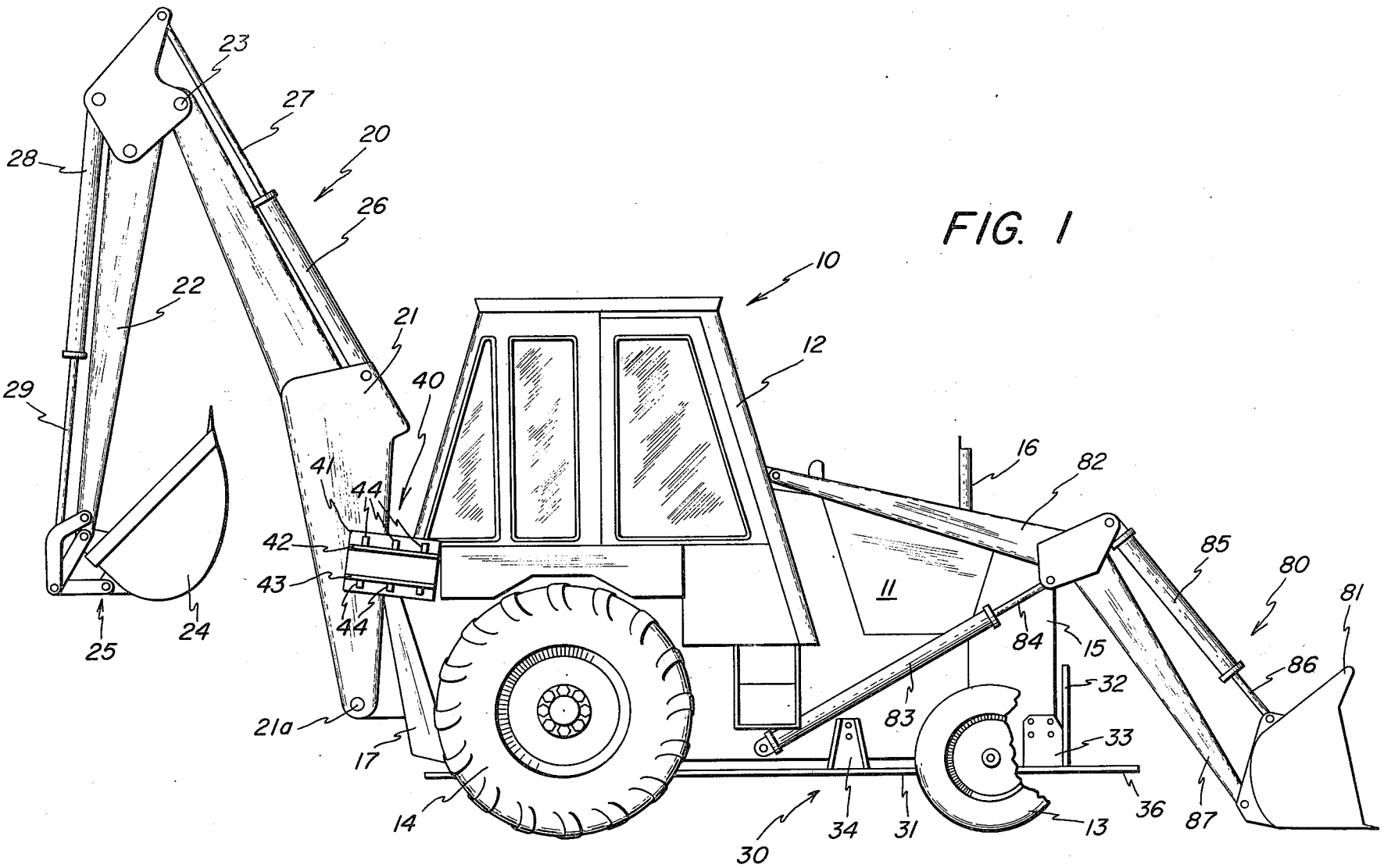
FIG. 1 is a side elevation view of apparatus in accordance with one embodiment of this invention comprising a backhoe having the modifications in accordance with this invention installed thereon.

FIG. 1 illustrates a backhoe modified in accordance with this invention to facilitate its use in the unloading of large open top containers. The backhoe of FIG. 1 comprises a tractor portion indicated generally at 10, a material working portion indicated generally at 20, and a front end loader apparatus indicated generally at 80. The tractor portion 10 comprises an engine and its associated housing 11, operator cab 12, wheel and tire assemblies 13 and 14, radiator 15 and exhaust stack 16 associated with engine 11, outrigger, or stabilizer arm, 17, and a transmission assembly, not shown, for connecting the mechanical drive output of engine 11 to wheel assemblies 13 and 14, stabilizer arm 17, and the drive means hereinafter described of material working assembly 20. Obviously, tractor portion 10 is bilaterally symetrical with respect to certain elements, for example, wheel assemblies 13 and 14 and stabilizer arm 17 are duplicated on the unshown side of FIG. 1.

Material working assembly portion 20 comprises boom 21 pivotably attached to tractor assembly 10 at pivot **21*a* at a first end of boom 21, and pivotably connected to dipperstick 22 at a second end of boom 21 at pivot 23. Dipperstick 22 is pivotably connected to boom 21 at a first end of the dipperstick at pivot 23, and at its other ends, is pivotably connected to bucket 24 by the journal mechanism indicated generally at 25. Relative movement between dipperstick 22 and boom 21 is effected by the operation of hydraulic cylinder 26 upon ram 27. Similarly, relative movement between bucket 24 and dipperstick 22 is effected by the operation of hydraulic cylinder 28 upon ram 29. Cylinders 26 and 28** are preferably doubled acting cylinders and are driven through hydraulic lines and fittings, not shown, as are known in the art.

Front end loader apparatus 80 comprises support arm 82 pivotably attached to tractor portion 10 at cab 12, bucket 81, bucket support member 87 pivotably connecting between bucket 81 and support arm 82, and hydraulic cylinders 83 and 85 acting respectively on rams 84 and 86 for causing movement of the elements of front end loader apparatus 80.

As so far described, the backhoe of FIG. 1 comprising tractor portion 10 and material working portion 20 constitute a conventional backhoe as is known in the art.

In accordance with this invention, material handling equipment such as the backhoe illustrated in FIG. 1 is modifed by the addition to the undercarriage thereof of a skidplate member indicated generally at 30, and clamp members, indicated generally at 40 to the outrigger or stabilizer arms of the machine, clamp member 40 being illustrated attached to stabilizer arm 17 in FIG. 1. As shown in FIG. 1, and as more particularly shown in FIGS. 2 through 5, and more particularly described hereinafter, skidplate member 30 comprises a main base plate member 31 providing a substantially smooth continuous undersurface, radiator protector member 32, and attachment means 34 for attaching skidplate member 30 to the motor mount of tractor 10, and attachment plate 33 for attaching skidplate member 32 to the frame of tractor 10. Clamp member 40 comprises base plate 41 having lateral protrusions 42 and 43 and transverse protrusions 44 extending therefrom attached at the extreme end of stabilizer arm 17. Skidplate member 30 provides for the support, and sliding transport, of the material handling equipment item atop an end wall of an open top container, and across the cargo load in the container on the lower surface of base plate member 31. Skidplate member 30 also includes radiator protector member 32 extending upwardly from the upper surface of base plate member 31 to protect radiator 15 of tractor 10 from damage. Base plate member 31 preferably extends beyond the forward end of tractor 10 a shown. Clamp members 40 are adapted to engage the side walls of an open top container for stabilization and support of the material handling equipment item on the container when the item is mounted and working on the container and the stabilizer arms, such as 17, are moved to their lowered positions.

Figure 3:
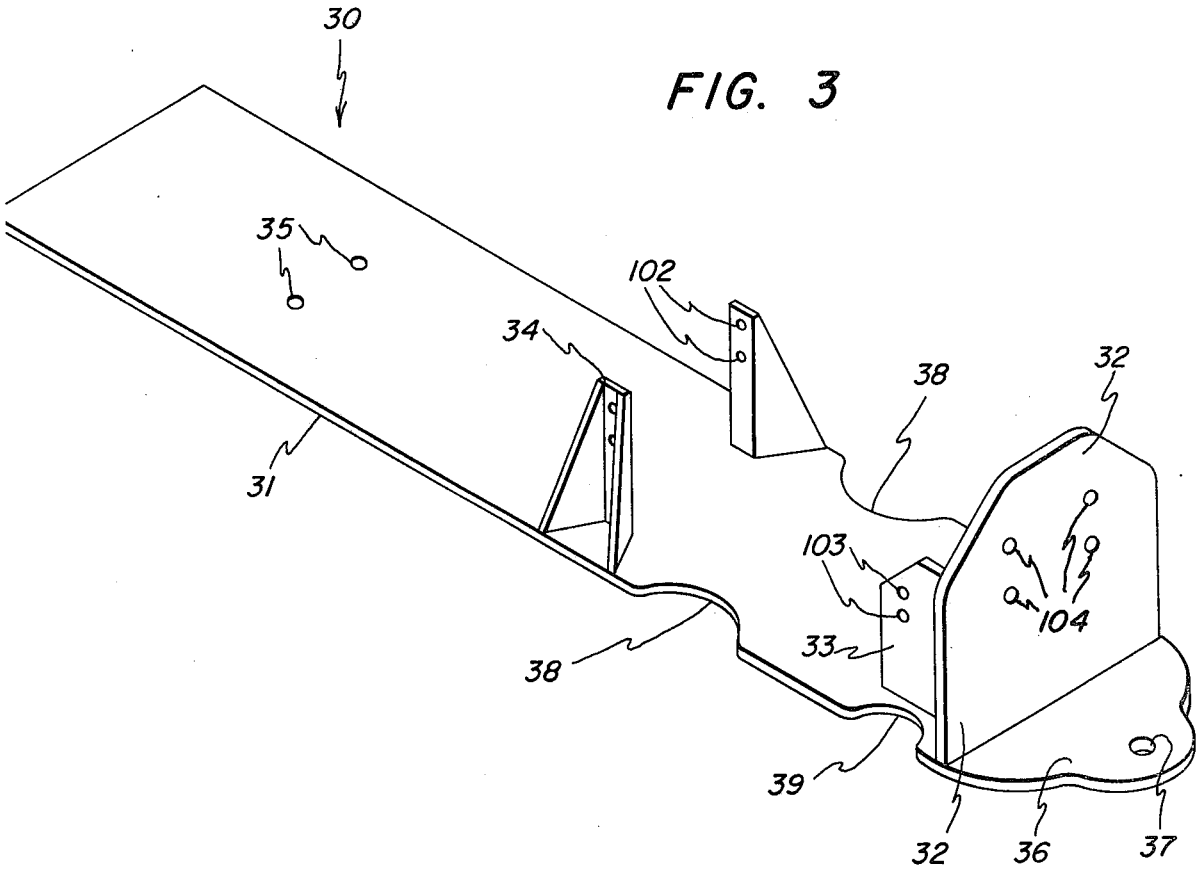
FIG. 3 is a perspective view of the skidplate member of FIG. 2.
Figure 2:
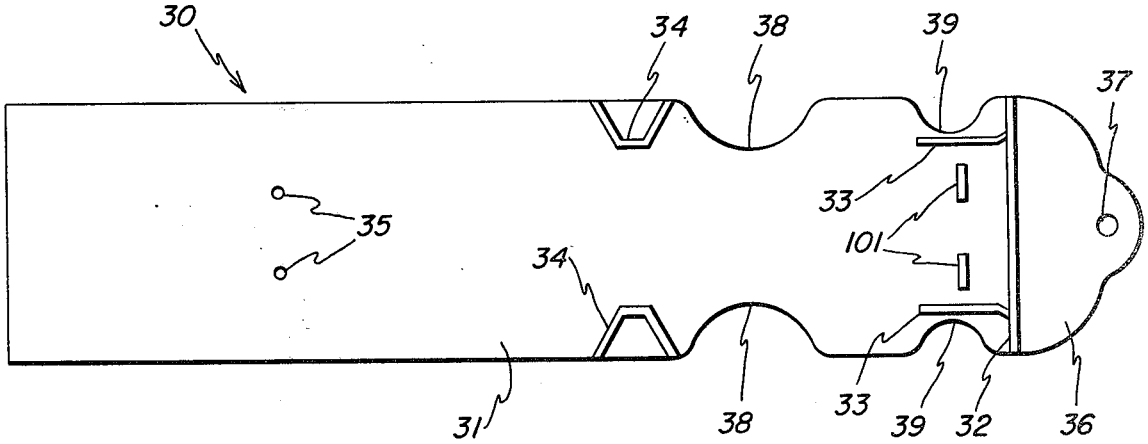
FIG. 2 is a top plan view of the skidplate modification member for installation on an item of material handling equipment such as the backhoe of FIG. 1.

A more detailed description of the modification items in accordance with this invention may be best understood with reference to FIGS. 2 through 5. FIGS. 2 and 3 are respectively a top plan view, and a perspective view of skidplate member 30. As shown in FIGS. 2 and 3, skidplate member 30 comprises a smooth flat base plate member 31 which may be formed of any sufficiently smooth, strong, and non-brittle material to support the weight of an item of material handling equipment over the area corresponding to the thickness of the upper surface of an end wall of an open top container by the width of base plate member 31. The lower surface of base plate member 31 must have sufficient smoothness to enable the equipment item to be propelled slidingly thereon without excessive abraision of the surface upon which the skidplate is riding, and with a low enough coefficient of friction to prevent binding. In the embodiment which has been actually reduced to practice, base plate member 31 was fabricated from steel sheet stock of ¾ thickness. The length and width of base plate member 31 are sufficient to completely underlie the undercarriage of the tractor portion of the material handling equipment item, so that no portion of the undercarriage is exposed and available to catch upon a surface over which the machine is being propelled. In the case of a rubber tired tractor, base plate member 31 has cut-outs 38 and 39 therein of sufficient length and radius to permit running and turning operation of the wheels which partially depend therethrough. In the case of a tracked vehicle, cut-outs such as 38 and 39 would not be required since it would be unnecessary to provide for turning operation. Base plate member 31 is provided with a pair of holes 35 for bolting the base plate to the rear housing of the tractor, a pair of mounting brackets 34, having holes 102 therein, for attachment of the skidplate at the engine or frame, and a pair of brackets 33, having holes 103 therein, for attachment of the skidplate to the frame of the tractor. The brackets are preferably attached to base plate member 31 by welding, and attachment of the brackets to the tractor is, in the preferred embodiment, accomplished through ¾ inch bolts. In the embodiment actually reduced to practice, the brackets, 33 and 34, were fabricated of ½ inch thick steel sheet stock. Skidplate member 30 also includes radiator protector member 32, which, in the embodiment reduced to practice, was fabricated from ½ inch thick steel sheet stock and which is attached, generally perpendicularly, to base plate member 31 by any convenient means, for example welding, and which extends upwardly from the upper surface of base plate member 31 to cover the lower portion of the radiator 15 of tractor 10 to protect the radiator from possible damage when the machine is in operation. Radiator protector member 32 additionally is provided with a plurality of holes 104 for further bolting of skidplate member 30 to tractor 10. In order to aid the apparatus in accordance with this invention in mounting an open top container to be unloaded, as more particularly described in the operational description set forth hereinafter, base plate member 31 is preferably provided with an extention portion 36 which extends beyond the end of the machine. Extention portion 36 of base plate 31 may conveniently be provided with tow hole 37 if desired. Skidplate member 30 also includes bumper blocks 101 configured and positioned to restrict relative vertical movement between base plate member 31 and the front axle of tractor 10 as the machine operates on a container. In the embodiment actually reduced to practice, bumper blocks 101 comprised steel blocks having dimensions of 1 inch by 5 inches by 6 inches high to restrict relative vertical movement between the skidplate and the front axle to approximately 6 inches. Bumper blocks 101 are preferably attached to base plate member 31 by welding.

Figure 4:
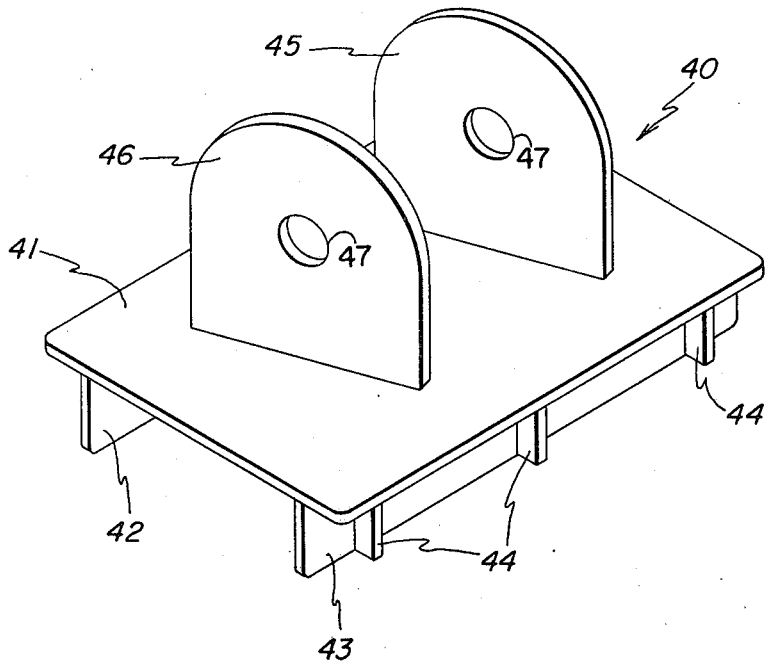
FIG. 4 is a top perspective view of a side wall clamp member for installation on a stabilizer arm of an item of material handling equipment, such as a backhoe, as illustrated in FIG. 1.
Figure 5:
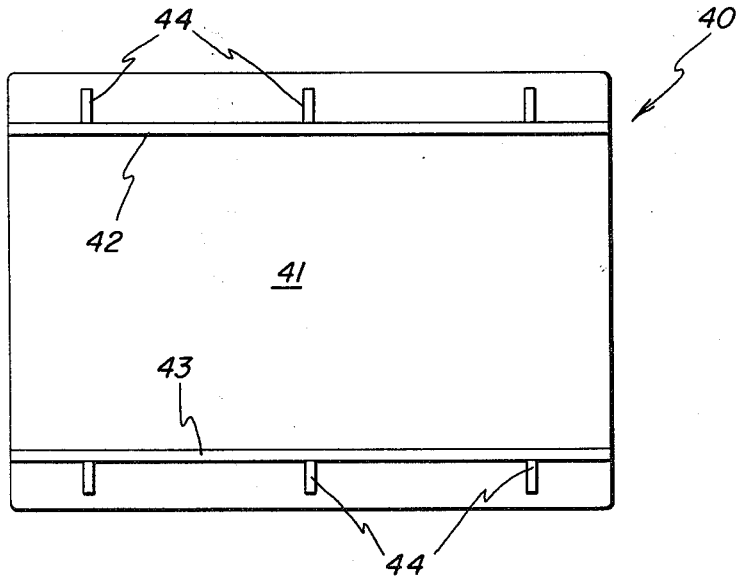
FIG. 5 is a bottom plan view of the clamp member of FIG. 4.

A more detailed description of clamp members 40 which are attached to the stabilizer arms of an item of material handling equipment, for example stabilizer arm 17 as shown in FIG. 1, for engaging the side walls of an open top container to stabilize and support the material handling equipment item on the container is best understood with reference to FIGS. 4 and 5. As shown in FIGS. 4 and 5, clamp members 40 comprise a base plate member 41 having a pair of mounting plates 45 and 46 disposed on a first surface thereof, and a pair of longitudinal wall members 42 and 43, and a plurality of transverse bracing members 44 disposed on a second, opposite, side thereof. Each of mounting plates 45 and 46 has a hole 47 therein for receiving a mounting pin, not shown, for attaching clamp member 40 to the end of a stabilizer arm of an item of material handling equipment, as is known in the art. Mounting plates 45 and 46 are preferably attached to base plate member 41 by welding, however, they may be formed by alternative means, as, for example, mounting plate members 45 and 46 might be formed integrally with base plate member 41 by, for example, casting the composite structure in a single mold. Mounting plate members 45 and 46 are preferably oriented at an angle with respect to the major dimensions of base plate member 41, said angle being selected to compensate for the angle at which stabilizer arms such as 17, depend from tractor 10. The compensating angle provides for the orientation of longitudinal wall members 42 and 43 parallel to the edges of an open top container clamped therebetween. Alternatively, such compensation could be provided by angling longitudinal wall members 42 and 43 on the lower surface of base plate 41 but such compensation by angling plates 45 and 46 is preferred for structural strength reasons. In the absence of such compensation, longitudinal members 42 and 43 would ride about the side wall of an open top container at an angle of resulting increase in likelihood of binding. As is understood in the art, mounting plates 45 and 46 are positioned on what is considered to be the upper surface of base plate member 41. The longitudinal wall members, 42 and 43 of the clamp member 40 in accordance with this invention are positioned on what is considered in the art the lower surface of base plate member 41. Longitudinal wall members 42 and 43 are preferably equal in length to the major dimension of base plate member 41, but are not necessarily co-extensive in length with base plate member 41. Longitudinal wall members 42 may be made either shorter or longer than the major dimension of base plate member 41 without departing from the scope of this invention. However, if the longitudinal wall members are shorter than the major dimension of base plate member 41, a less effective clamp is obtained, as will be apparent from the operational description set forth hereinafter. On the other hand, if longitudinal wall members 42 and 43 extend beyond the edges of base plate member 41, the portion of longitudinal wall members 42 and 43 so extending will lack the support provided by the base plate and the transverse bracing members. Longitudinal wall members 42 and 43 are disposed upon the lower surface of base plate member 41 in a generally parallel relationship to each other, a generally perpendicular relationship to the base plate member, and are separated from each other by a distance preferably slightly exceeding the thickness of the sidewalls of the open top container to be unloaded. Side wall members 42 and 43 are preferably attached to base plate member 41 by continuous bead welds. Transverse bracing members 44 are attached to side wall members 42 and 43 on the outer surfaces thereof, and to base plate member 41 on the lower surface thereof, and serve to brace and strengthen side wall members 42 against outward pressure from the side wall of an open top container being unloaded and whose upper edge is positioned in clamp members 40 between side wall members 42 and 43 with the upper surface of the container side wall supporting a portion of the weight of the material handling equipment item by pressure against base plate member 41. Transverse bracing members 44 are disposed generally perpendicularly to both side wall members 42 and base plate member 41, and generally parallel to each other. Bracing members 44 serve a further significant function when the material handling equipment item is operated conventionally, as opposed to the container unloading function. Transverse bracing members 44 are preferably attached both to base plate member 41 and sidewall members 42 and 43 by continuous bead welds. Base plate member 41, side wall members 42 and 43, and transverse bracing members 44 are all preferably formed of ¾ inch thick steel. In the embodiment which was actually reduced to practice, and which was intended for the unloading of railway gondola cars, side wall members 42 and 43 were spaced on 12 inch centers, and were 6 inches in height. Transverse bracing members 44 were 3 inches in length, 6 inches in height, and were set on 8 inch centers.

Clamp members 40 in accordance with this invention may, of course, be fabricated from each of the individual components as hereinabove described. Alternatively, clamp members 40 may be fabricated by beginning with the elements normally present on an item of material handling equipment as known in the art. Material handling equipment having stabilizer arms are normally furnished in the art with pin mounted plates at the ends of the stabilizer arms. Therefore, the equivalent of base plate 41 having mounting plates 45 and 46 on the upper surface thereof is normally furnished with a material handling equipment item as known in the prior art. The lower surface, however, of the base plate as used in the prior art, is characterized by having attached thereto a plurality of metal sheet members depending therefrom in a generally cruciform configuration for providing an earth gripping surface. The cruciform configuration is obviously inappropriate for clamping to the side walls of an open top container, and in fact will obviously prevent such use, while being obviously very well adapted to providing a gripping surface for a soft material, such as earth. Therefore, an alternative method of constructing clamp members 40 in accordance with this invention involves the removal of the cruciform depending gripper members from the base plate furnished with the material handling equipment item, and the installation on that base plate of longitudinal wall members 42 and 43 and transverse bracing members 44 in place of the gripper surface members.

The operational function of the pads at the ends of stabilizer arms of the machines known in the art is to provide stabilization when the machine is working on earth by depressing the members depending from the base plate into the earth. Thus, it may be seen that the cruciform patern of the depending members is well suited to the performance of the function required, and that the clamp members in accordance with this invention would not be well suited to the performance of the earth stabilization function of a machine in accordance with this invention when conventionally used if they comprised only longitudinal wall members 41 and 42 without transverse bracing members 44. However, it may also be seen that with the addition of transverse bracing members 44, clamp members 40 provide for the performance of the conventional earth stabilization function quite as adequately as the cruciform patern of the stabilizer pads of the prior art.

In view of the foregoing, it may readily be seen that the above-described improvements of this invention admirably achieve the objects of modifying conventional material handling equipment items to perform the function of unloading open top containers by modifications which are inexpensive to manufacture, simple to install, and which permit the conventional operation of the material handling equipment item without the necessity of removing the modifications.

The base plate member underlying the tractor undercarriage serves, when the equipment item is used conventionally, only as an underlying cover for the tractor undercarriage. The inclusion of the base plate under the tractor does not interfere with conventional operation of the machine in any significant respect, and only has the effect of decreasing the average ground clearance of the machine by a small amount to a constant value. For example, in the case of the case 580B backhoe in the embodiment actually reduced to practice, the tractor base plate member is bolted directly to the rear housing, the lowest point in the unmodified tractor, and the ground clearance of the entire tractor as modified is the same as the ground clearance of the unmodified tractor at the point of the rear housing. Similarly, as discussed above, the clamp members attached to the ends of the stabilizer arms of the machine in accordance with this invention are capable of performing both the side wall clamp function for which they are specifically designed, and the function of conventional stabilizer pads which they replace.

The apparatus in accordance with this invention is generally applicable to the unloading of any large open top container in which the tractor base plate may reset upon a portion of the load and in which the container has an end wall upon which the tractor base plate may ride, and side walls which may be engaged by the clamp members described hereinabove. For example, the apparatus in accordance with this invention may be used to unload railway cars, barges, and ship holds. The method and apparatus of this invention have been successfully employed in the unloading of railway gondola cars, and particularly in the unloading of a plurality of gondola cars in a train in accordance with the operational procedures described hereinafter. The method and apparatus of this invention are particularly useful in the unloading of trains of gondola cars, but the following description is not to be taken as a limitation on the general applicability of this invention.

The use of apparatus in accordance with this invention in the unloading of a railway gondola car is illustrated in FIG. 6. FIG. 6 shows a backhoe comprising tractor portion 10 and material handling portion 20 mounted atop a railway gondola car indicated generally at 60. Gondola car 60 has side walls 61 and end walls 62. Gondola car 60 contains a load of material 63 therein. When mounted atop a gondola car, the apparatus of this invention is supported and stabilized by the engagement of clamps 40 with side walls 61 of the gondola car, stabilizer arms 17 being in the depressed position, wheels 13 and 14 in contact with load material 63, and skidplate member 30 supported on load material 63 and/or an end wall member 62. The apparatus is moved along the loaded gondola car in the direction indicated by arrow 65. The load material 63 underlying the apparatus so that drive wheels 14 may act thereagainst to propel the apparatus in the direction indicated by arrow 65. It may be readily seen, that the apparatus of this invention is wholly supported by the gondola car 60 and its contents 63, and is accordingly completely mobile with the gondola car. In contradistinction to the prior art car unloading apparatus discussed hereinabove, the apparatus of this invention is therefore capable of unloading a portion of a gondola car at one location, traveling with the train including the gondola car to another location, and unloading a further portion of a gondola car at such second location, and so on for as many such locations as may be desired. It may also be noted that the unloading method and apparatus of this invention may be employed while gondola car 60 is in motion if desired and if the load material 63 is sufficiently sturdy to withstand being off-loaded at the velocity at which the train is moving. The particular applicability of the method and apparatus of this invention to the railway right-of-way maintenance operation discussed hereinabove should now be completely apparent to those skilled in the art. In the tie replacement operation, the maintenance train proceeds to each point along the right-of-way at which tie replacement is required, slows or stops while the number of ties required are off-loaded from the gondola car by the apparatus of this invention, and proceeds to the next area at which ties are required. Subsequently, after the required ties have been deposited along the right-of-way a maintenance crew, known as a "high speed tie gang" proceeds along the right-of-way installing the ties which have been deposited in accordance with this invention.

The method and apparatus of this invention also advantageously provides for the complete unloading of a container. As the apparatus proceeds along the container, the front portion of the apparatus is generally supported by a full load of material in the container. As material is off-loaded to the rear of the apparatus, the rear portion of the apparatus is further supported by stabilizer arms acting against the side walls of the container through clamp members 40. In this manner, approximately three-quarters of the container can be unloaded with the apparatus atop the container being unloaded as described. When the front of the apparatus reaches the end of a container the front end loader apparatus 80 is depressed to bring front end loader bucket 81 into contact with the next succeeding container and additional downward pressure is applied by bucket 81 against the next succeeding container to raise the front end, including wheels 13, of tractor portion 10 of the apparatus of this invention to the level of the top of the end wall 62 of the first container. Drive wheels 14 of tractor 10 are then driven to propel the apparatus across any gap between containers until extention portion 36 of base plate member 31 is in contact with the end wall of the next container. The front end loader bucket 81 is then raised to an out-of-the-way position and the tractor of the apparatus is driven across the end walls 62 of the adjacent containers with a sliding contact between base plate member 31 and the end walls. At a convenient point, for example when drive wheels 14 are positioned between the containers, the tractor is stopped. At this point, clamp members 40 are still engaging the side walls 61 of the first container and the major portion of tractor 10 is in the second container. The unloading of the first container by material handling members 20 may then be completed. After the completion of unloading of the first container, stabilizer arms 17 are raised, freeing side walls 61 of the first container from clamp members 40, and the tractor is driven completely into the second container. When the apparatus is driven sufficiently far into the second container to allow unloading of the second container to begin, stabilizer arms 17 are again lowered to cause clamps 40 to engage the side walls of the second container and the unloading process as heretofore described may be repeated.

In order to aid in the grasping of material to be unloaded, the apparatus of this invention may be further modified by the addition, on the interior edge of dipperstick 22 of material working portion 20, of a hydraulically operated grasping member operating in opposition to the bucket 24, such as known in the art as a "big thumb." As another alternative, a metal block may be attached, as for example by welding, to the inner surface of dipperstick 22 at a position along dipperstick 22 so as to cooperate with the outer edge of bucket 24, when in its maximum flexion position, to grasp material. Another modification which may be employed, if desired, to assist in the performance of the grasping function is to modify bucket 24 itself by providing a generally semi-circular cut-out in the upper portion thereof and reinforcing the remainder of the bucket. The foregoing are but examples of modifications which may be used to aid the grasping function. Other functionally equivalent modifications will occur to those skilled in the art, and are within the scope of this invention.

In accordance with another advantageous feature of the method of this invention, the apparatus of this invention may be mounted atop a container, for example a railway gondola car, under its own power, by a process similar to the process of transferring the apparatus from container to container described immediately hereinabove, and without the need for additional specialized structure. The process is illustrated in FIGS. 7–13. First, a flat car is positioned adjacent a low side gondola car. Tractor 10 is driven up to the free end of the flat car and front end loader bucket 81 is depressed against the upper surface of the flat car to raise the front end of tractor 10 at an angle pivoted about the axle of drive wheels 14 until extention portion 36 of base plate 31 contacts the upper surface of the flat car. See FIG. 7. Drive wheels 14 are then driven to propel the tractor 10 up onto the upper surface of the flat car by sliding the tractor over the edge of the flat car on base plate member 31. Material handling portion 20 is then operated to exert a downward pressure on the ground by bucket 24 to aid in mounting the flat car by raising the rear portion of tractor 10 to the level of the flatcar. See FIG. 8. The apparatus is then driven across the top of the flatcar. The front end loader bucket 81 is then raised to engage the upper surface of the end wall of the low side gondola. A downward pressure is then exerted on bucket 81 to raise the front end of tractor 10 as before. When extention portion 36 engages the upper surface of the end wall of the low side gondola bucket 81 is again raised to a convenient noninterfering position, and tractor 10 is again driven over the edge of the low side gondola car on base plate 31 and material handling portion 20 is again operated in a fashion similar to the mounting of the flatcar hereinabove described. See FIGS. 9 and 10. The tractor may then be driven into the low side gondola car to a position at which unloading may begin, the stabilizer arms lowered to engage the sides of the low side gondola by clamps 40 as previously described and unloading operations commenced. A high side gondola car may be mounted by the apparatus of this invention from a low side gondola by a process identical to the mounting of the low side gondola car from the flat car as described immediately previously. It has also been found in experimental use of the apparatus of this invention that a high side gondola car may be mounted directly from a flatcar when necessary. However, if possible, it is preferred to step from the flatcar to a low side gondola car to a high side gondola car.

Similarly, the method of this invention provides for an analogous operation to the procedure for mounting the apparatus of this invention atop a container to be unloaded for bringing the apparatus down from the container. When the last container has been unloaded, and it is desired to return the apparatus to the ground, the front end of the apparatus is driven over the edge of the container so that the forward portion of tractor portion 10 is resting on an end wall of the container on base plate member 31. The front end loader apparatus 81 is then moved to a lowered position and material handling portion 20 is depressed against the bottom of the container to tip the apparatus about the end wall. Then, by cooperative action of the front end loader apparatus and the backhoe apparatus, the apparatus of this invention is slid, on skid plate 30, across the edge of the container and returned to the ground. See FIGS. 12 and 13.

While this invention has been described with reference to particular embodiments and examples, other modifications and variations will occur to those skilled in the art, in view of the above teachings. Accordingly, it should be understood that within the scope of the appended claims the invention may be practiced otherwise than is specifically described.

The invention claimed is:

1. Apparatus for adapting a material handling equipment item for unloading open top containers, said material handling equipment item having a tractor portion and at least a first material working portion;

said tractor portion having an undercarriage including frame, engine, axle, transmission, and rear housing members, means attached to said axle members for propelling said material handling equipment item across a surface, said tractor portion further having moveable stabilizer arms attached thereto;

said first material working portion having first and second pivotably connected arms connected to each other at a first end of each arm, a material grasping member pivotably connected to a second end of said second arm, a second end of said first arm being pivotably connected to said tractor portion, and means for causing relative motion between said arms, between said tractor portion and said first arm, and between said second arm and said material grasping member;

said open top container having end walls, and side walls;

said apparatus for adapting comprising:

a substantially smooth continuous skidplate member attached to said undercarriage and underlying said engine, axle, transmission, and rear housing members; and first and second clamp members respectively attached to ends of a first and second of said stabilizer arms for engaging said side walls when said stabilizer arms are lowered.

2. The apparatus as claimed in claim 1 wherein said skidplate member comprises:

a substantially smooth continuous base plate member; and a plurality of bracket members disposed on an upper surface of said base plate member for attaching said base plate member to said frame member.

3. The apparatus of claim 2 wherein said base plate member includes an extension portion extending beyond the forward end of said tractor portion, and wherein said skidplate member further comprises:

a radiator protector member disposed on said upper surface of said base plate member on said extension portion for protecting a radiator of said tractor portion from damage;

a pair of bumper blocks disposed on said upper surface of said base plate member at a location on said base plate member underlying one of said axle members for restricting vertical movement of said axle member relative to said skidplate member; and means for attaching said base plate member to said rear housing member.

4. The apparatus of claim 3 wherein said means for attaching comprises a plurality of holes in said base plate member for bolting said base plate member directly to said rear housing member, and further including:

a pair of bracket members disposed on opposite sides of said upper surface of said base plate member to said engine member.

5. Apparatus as claimed in claim 1 wherein each of said clamp members comprises:

a base plate member having first and second sides;

mounting bracket means attached to said first side of said base plate member for attaching said base plate member to an end of one of said stabilizer arms; and means attached to said second side of said base plate member for acting cooperatively with said base plate member to surround an upper portion of one of said side walls of said open top container on three sides and to support said material handling equipment item on side wall.

6. The apparatus of claim 5 wherein said means attached to said second side comprises:

a pair of longitudinal wall members disposed on said base plate member in a generally parallel spaced relationship to each other; and a plurality of transverse bracing members, each said transverse bracing member being attached to said base plate member along a first edge of said bracing member and to one of said longitudinal wall members along a second edge of said transverse bracing member.

7. The apparatus of claim 5 wherein said mounting bracket means are disposed at an angle preselected to compensate for the angle between said stabilizer arms and said tractor portion, and wherein said mounting bracket means include holes for receiving a pin to pivotably attach said base plate member to said end of one of said stabilizer arms.

8. A method of unloading an open top container having end walls and side walls by means of an item of self propelled material handling equipment having a tractor portion, first and second material handling members, a skidplate member underlying said tractor portion, and clamp members adapted to releasably engage said side walls comprising the steps of:

mounting said item of material handling equipment upon said open top container by the operation of the self propelling means of said item of material handling equipment;

stabilizing said item of material handling equipment upon said open top container by resting said skidplate upon material within said open top container and engaging said sidewalls with said clamp members;

removing a portion of said material from said open top container by operation of said second material handling member;

driving said item of material handling equipment to another position upon said open top container; and removing another portion of said material from said open top container by operation of said second material handling member.

9. The method of claim 8 wherein said mounting step more particularly comprises:

placing said first material handling member upon an edge of one of said end walls;

depressing said first material handling member to raise said item of material handling equipment so that said skidplate engages said edge of said end wall; and driving said item of material handling equipment across said edge.

10. The method of claim 9 further including the additional step of:

moving said item of material handling equipment from said open top container to a succeeding open top container in a train of open top containers solely by the operation of the self propelling means of said item of material handling equipment.

11. The method of claim 10 wherein said moving step more particularly comprises:

driving said item of material handling equipment to a position on said open top container at which said first material handling member is above an edge of an end wall of said succeeding open top container;

depressing said first material handling member to raise said item of material handling equipment so that said skidplate engages said edge of said end wall of said succeeding open top container; and driving said item of material handling equipment across said edge.

12. The method of claim 11 including the additional step of:

removing a portion of said material from said open top container by operation of said second material handling member after said item of material handling equipment has been moved to said succeeding open top container.

13. The method of claim 12 wherein said step of removing after said item of material handling equipment has been moved to said succeeding open top container more particularly includes emptying said open top container of said material.

14. The method of claim 10 further including the step of:

demounting said item of material handling equipment from a last open top container in said train of open top containers solely by the operation of said self propelling means.

15. The method of claim 14 wherein said demounting step more particularly comprises:

driving said item of material handling equipment to a position on said last open top container at which said skidplate engages an end wall of said last open top container; and depressing said second material handling member to pivot said skidplate upon said end wall.

* * * * *